United States Patent [19]

Callahan

[11] Patent Number: 4,643,862

[45] Date of Patent: Feb. 17, 1987

[54] REFRACTORY STOVE DAMPER WITH CATALYTIC EFFECT

[76] Inventor: Earnest J. Callahan, 2207 Sims Way, Port Townsend, Wash. 98368

[21] Appl. No.: 755,691

[22] Filed: Jul. 16, 1985

Related U.S. Application Data

[63] Continuation-in-part of Ser. No. 577,388, Mar. 29, 1984.

[30] Foreign Application Priority Data

Mar. 7, 1985 [CA] Canada ..... 476013

[51] Int. Cl.[4] ..... C04B 41/00; F23L 3/00

[52] U.S. Cl. ..... 264/133; 264/232; 264/333; 126/292; 126/285 R; 110/203; 110/163

[58] Field of Search ..... 126/292, 285 R, 120, 126/121, 126, 83, 288, 293; 422/177; 110/163, 203; 264/133, 232, 333, 344

[56] References Cited

U.S. PATENT DOCUMENTS

| | | | |
|---|---|---|---|
| 2,090,604 | 8/1937 | Anderson | 126/292 |
| 2,914,808 | 12/1959 | Adams | 264/233 X |
| 2,921,357 | 1/1960 | Fujii | 264/233 X |
| 3,598,067 | 8/1971 | Jones | 110/163 |
| 3,859,405 | 1/1975 | Horton | 264/133 X |
| 4,027,654 | 6/1977 | Kannapell | 126/285 R |
| 4,125,380 | 11/1978 | Negola | 422/180 |
| 4,276,331 | 6/1981 | Bothwell | 422/180 X |
| 4,279,629 | 7/1981 | Simms | 110/163 X |
| 4,345,528 | 8/1982 | Allaire et al. | 110/203 |
| 4,373,452 | 2/1983 | Van Dewoestine | 110/203 |
| 4,373,507 | 2/1983 | Schwartz et al. | 126/289 |
| 4,489,109 | 12/1984 | Puskar | 264/133 X |

*Primary Examiner*—Larry Jones

[57] ABSTRACT

Disclosed herein is a preferred process for making a catalyst. A catalyst such as is named in the title of this invention. The process begins with the chosing and blending the different refractories in order to necessitate the longevity of the damper. The mixing of the materials, with water, to the right consistency is very important in this process. To much moisture in the material will not provide the necessary porosity the catalyst needs. After mixing, the dampened material is placed into a two piece break away mold and pressed into the desired shape, size and density. The proper amount of curing time and the damp cool area in which the curing is to take place also adds to the longevity of the damper. The object of this invention is to provide an inexpensive process that doesn't require heat, for manufacturing a catalyst that will not become contaminated or less active with use, but by it's causing a more complete combustion, will create a higher BTU output and a decrease in fuel consumption.

6 Claims, 3 Drawing Figures

REFRACTORY STOVE DAMPER WITH CATALYTIC EFFECT

This application is a continuation-in-part of application Ser. No. 577,388, filed 3-29-84, pending.

FIELD OF INVENTION

This invention pertains to stove dampers, particularly stove dampers which provide catalytic action to reduce pollutants and ensure complete combustion.

BACKGROUND OF INVENTION

Owing to the recent fuel embargos and shortages, the use of wood stoves for heating has grown in the United States. Many modern stoves limit the amount of air to conserve fuel. The result is incomplete combustion and increased incidence of air pollution.

When wood completely burns, the normal result is water, carbon dioxide and a small amount of particulate matter. If the amount of oxygen is limited, for example if there is a smoldering fire in an airtight stove, combustion is incomplete. Incomplete combustion results in water, carbon monoxide, carbon (soot), hydrocarbons (creosote), and similar products. Several of these products are serious pollutants and have led to legal limitations on wood stove use in some communities. In addition, creosote condenses in cool portions of stove pipes and becomes a fire hazard. Finally, if combustion is incomplete, burning of the fuel produces fewer calories than complete combustion resulting in lower efficiency.

Due to the above problems, there have been many attempts to provide more complete combustion. The simplest is to provide adequate oxygen for combustion. While this method is simple in theory, in practice it is difficult to accomplish without constant monitoring of the stove and type of fuel. A second method proposed is injection of air into the combustion chamber of the flue to cause additional combustion. A problem that arises with this method is that while there is sufficient oxygen to burn the combustion products, there is insufficient heat to allow proper ignition. For this and similar reasons, addition of air is only partially successful. It has been proposed to add a catalytic converter to the stove or flue to reduce the temperature of ignition. The catalysts proposed are generally metals or metal coating on ceramic. Such catalysts are prone to poisoning and are relatively expensive. In addition, most designs create excessive back pressure which can fill the room in which the device is located with smoke. Accordingly, a need has arisen for an inexpensive reliable device which provides complete combustion in wood stoves.

SUMMARY OF THE INVENTION

The invention provides a simple inexpensive device for increasing the efficiency in wood stoves. In addition, the device functions as a long lived Damper, because the refractory material is not subject to corrosion as are metal dampers.

The damper is made of a castable refractory material that has been specially blended from two different types of refractories and their cements. This blending process has brought about the success of the damper.

The damper may be mounted in a stove pipe in a manner similar to a conventional damper, or if the element is made with enough porosity, it may be manufactured without holes and placed in a stationary position in the flue or stove pipe.

The refractory damper is relatively thick and pierced with a number of holes. The holes are carefully placed so there is enough mass material between them to prevent burnout and to provide more collectible surface area for absorption. In use the refractory element is a high heat absorbing porous body, due to the special manufacturing process. It quickly attains combustion temperature from the passage of hot combustion products. It's absorption qualities allow it to absorb large amounts of smoke and particulate matter being produced by the fire. These materials actually penetrate directly into the embodiment of the Damper, and as the fire starts to die down and these materials are being produced at a faster rate, they will penetrate even deeper into the Damper where the temperature remains much hotter for a longer period of time. The Damper will remain active as long as there is a minimum amount of oxygen going into the firebox.

The result is complete combustion and greater efficiency with a loss of pollutants.

DESCRIPTION OF THE PREFERRED EMBODIMENT

Figure 1:
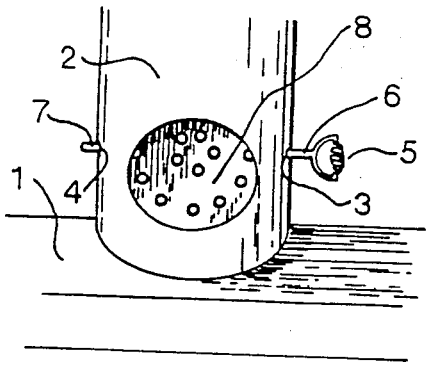
FIG. 1 is a perpective partial section view of the device in a working environment.

FIG. 1 is a perspective view of a wood stove with the invention installed. A portion of the stovepipe is cut away. A wood stove is shown with an attached stovepipe. Wood stove 1 may be any conventional wood stove. Stovepipe 2 is a standard round stovepipe of 6" diameter in the embodiment shown. A person skilled in the art could easily modify the invention to fit over sizes or types of stove or stovepipe. Stovepipe 2 is provided with two pivot holes 3, 4. A pivot pin 7 passes through hole 4 and a handle pin 6 passes through hole 3. A handle 5 is attached to handle pin 6. The damper element 8 is attached to pins 6,7 in such a manner that rotation of handle 6 causes damper element 8 to rotate in stovepipe 2. Operation of the damper is similar to conventional dampers to this point. The damper is installed in a manner similar to conventional stove dampers and is thus readily usable in existing installations.

Figure 2:
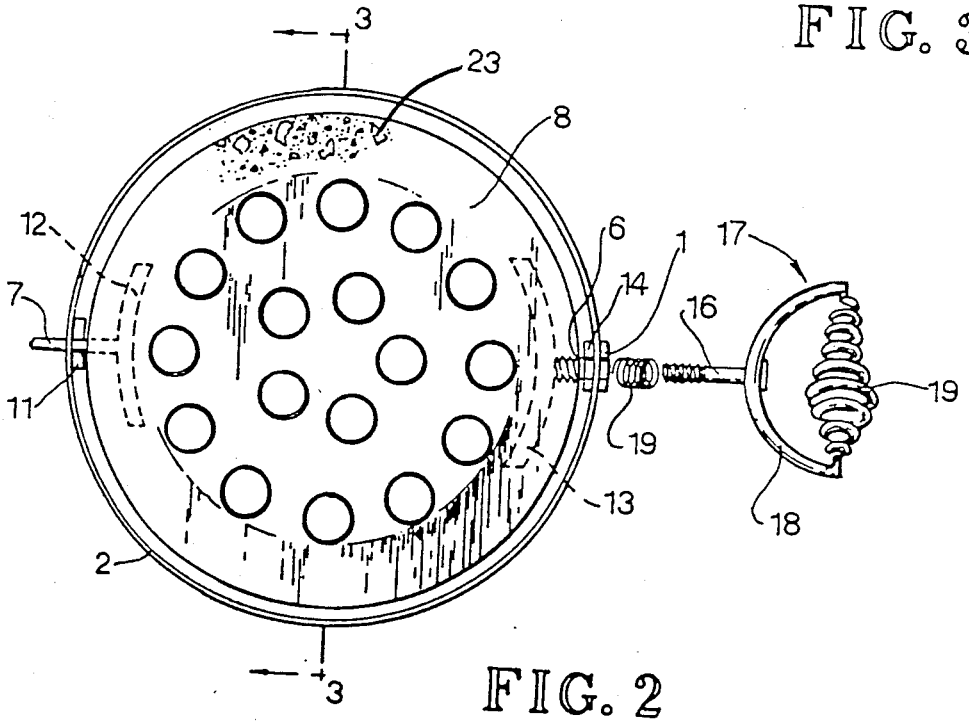
FIG. 2 is a front elevation view of the damper element of the device in a stovepipe.

FIG. 2 is a front elevation view of the damper element of FIG. 1. The view is of the element 8 in a closed position in a stovepipe 2. Pivot pin 7 passes through hole 3 in pipe 2. Pivot pin is surrounded by a washer 11 which is situated between pipe 2 and element 8. Pin 7 is attached at one end to an anchor 12 inside element 8. Anchor 12 is a steel bar in this embodiment, but an equivalent could be substituted. Similarly, handle pin 6 is attached at one end to a second anchor 13 and surrounded by a washer 14. The other end of handle pin 6 provides a threaded handle assembly 17 which in turn is comprising a spring 19 stretched between a bar 18. A second spring 19 and second washer 20 complete the pivot assembly.

The Grogs 23 play a most essential part in the absorption qualities of the Damper.

Damper element 8 includes a plurality of holes for passage of combustion products. In the embodiment shown, the holes are about one-half inch in diameter and are tapered to allow release from the mold. Tapering is helpful for construction, but not essential to operation of the damper. This embodiment is for relatively wet wood. For dry wood, it may be desirable to use fewer holes or holes of smaller diameter. In this embodiment, there is an inner circle 21 of 5 holes surrounded by an outer circle 20 of 12 holes. This number of holes and size is suitable for green wood and a 6" diameter stovepipe. For larger pipes there could be more holes to prevent back pressure, or another alternative to obtain the same results, would be to provide more porosity in the element. It is important to maintain at least 11% porosity.

Figure 3:
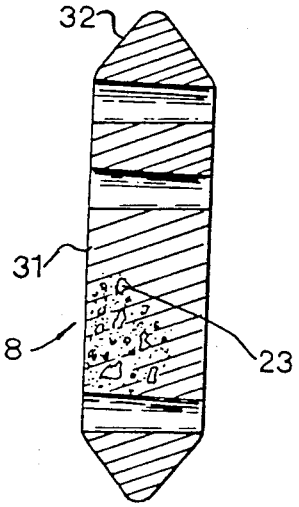
FIG. 3 is a section side elevation view of the damper element.

FIG. 3 is a section side elevation view of the damper element 8 of the invention along line 3—3. It is apparent that the central section 31 of the damper element 8 is cylindrical in shape. The thickness of section 31 is preferably one and one-half inches, although larger dampers may require greater thickness for strength. The diameter of section 31 is about three and one-half inches for a 6 inch diameter stovepipe. An outer section 32 of damper element 8 tapers to an outer thickness of one-eigth inch to allow easy rotation within a stovepipe. Section 32 extends from a diameter of three and one-half inches to within one-eigth to one-fourth inch of the diameter of the stovepipe in which installation is desired.

METHOD OF MANUFACTURE

Damper element 8 is molded from castable refractories, products of North American Refractory of Renton, Wash.

The two different materials used are supplied in separate containers and must be first dry mixed together. Once the materials are blended together, they are placed into a high speed mixer. About 18 pounds at a time is mixed with ice water. The ice water is essential to provide more working time, by slowing the set. Very little ice water must be used, just enough to make the material damp enough to stick together when squeezed by hand, but not to the point of making it flow.

It is essential that the area where the manufacturing is to be done is damp and cool. If necessary, water coolers must be used to add humidity to the room.

The material is then placed into a lubricated two piece breakaway mold with an impact closing pressure of 2500 pounds of pump pressure using a 2½ inch bore diameter cylinder which creates 12,275 psi force and then is held.

The bottom cylinder is attached to a steel plate housing ½" steel pins, which taper to a point. It has 2500 pounds pump pressure and a 3½" bore diameter cylinder and creates 25,050 psi. A vibrator is attached to the steel plate housing the steel pins. The vibrator is then turned on and the bottom cylinder is taken up. As the pins start to enter the damp material, tremendous pressure will be created inside the mold. Any excess material will be pushed out the top of the mold.

The vibrator is then turned off, the bottom cylinder is lowered and the mold is opened. This process takes approximately one and one half minutes.

The then pressed material is lifted out of the mold, placed on a pallet and then placed on a layered rack that has been covered with burlap. The burlap must be dampened approximately every 15 minutes. If the dampers dry to quickly they will become crumbly a short time after use. If they are to wet when they are made, they will be far less efficient as small particles of material will be brought to the surface causing the pores to be sealed. This takes away most of it's absorption qualities.

The material must have at least 24 hours of dampness so it can chemically bond.

It was originally thought that elevated heat could be applied during manufacturing. This has proven not possible, because the chemicals in the cement require time in a damp cool area to chemically bond.

After 40–60 dampers have been made, they are taken to an even damper area.

It is essential that they stay in this area for at least 24 hours. They are then removed and dipped into a latex type material to further retard the set by trapping in the remaining moisture. They are then hung to air dry at room temperature for about four days and are then ready for use.

THE REFRACTORY

Prior art of Carmine Negola U.S. Pat. No. 4,125,380, section 2 line 32, dated Nov. 14, 1978, shows the use of refractories being taught by using either a 2400 degree heat range or a 3400 degree heat range, which would indicate the use of two different refractory materials or their cements.

I am claiming that by blending the two different heat range refractories and their cements, the life of the Damper can be extended considerably.

In blending, the first formula used has a heat range of 2600 degrees and uses a green colored cement. The materials consist of 41.1% AL, 40.9% SI, 2.4% TIT and 3.5% ferric oxide. The grogs, which are most essential, make up about 47% of the total volume of the refractory material. They range in size from about 1/16" to ¼". If only this type of material is used, flaking and peeling can be expected to start after about 8000 hours of use.

Formula 2 has a white colored cement (cement colors are mentioned for identification purposes only). This material consists of 53.2% AL, 39.5% SI, 1.5% TIT and 0.7% ferric oxide. It has a temperature range of 3000 degrees and also has a very essential 47% grogs ranging in size from 1/16" to ¼" in size. This material by itself has very little, if any, catalytic properties. When a refractory element is formed from just this material, the cements seal the pores in the opening of the crust of the element and also seal around the grogs so pollutants cannot be absorbed into its embodiment.

If 25% of formula 2 is blended with 75% of formula 1, it will more than triple the life of the element. Formula 2 is needed to keep the first mixture from flaking and peeling after approximately 8000 hours of use.

It is essential that the refractory material to be used be tested for catalytic properties.

Although different size grogs (which consist of ground fire brick), may be used, we prefer between 1/16" and ¼" in size. The larger grogs could be used in an element which would'nt require holes. The grogs are one of the most important ingredients in the refractory mixture. When the refractory material is pressed, voids will appear around the grogs, creating natural crevices. These are passage ways for smoke and pollutant materials to enter the embodiment of the element and be consumed by the extreme heat there within. Of course it is important that the material is not over pressed or it will seal the pores.

HOW IT WORKS

One need to have an understanding of the way the catalyst was made to understand how it functions.

Combustion occurs in at least three different areas in the damper.

1. Combustion occurs from the gases that pass through the holes which have become lined with thin carbon fragments.
2. The most obvious combustion takes place on the surface area of the catalyst.
3. The least obvious combustion takes place inside the embodiment. Because the catalyst is non metallic and has a rough texture, carbon fragments will start to accumulate on the walls inside the hole area after approximately 72 hours of use. As thin pieces of carbon collect inside the holes, they begin to flicker, glow and then burn with no flame or an invisible flame for a considerable time. As this process is occurring, more gases and particulate matters are being filtered from the smoke and are being consumed by the already glowing carbons. These materials then burn as the first ones did and the entire process is repeated over and over again, making it a continuous cycle throughout the complete burning period.

The temperature of the catalyst stabilizes at a higher temperature than the flue gases would normally be. Because of it's great porosity and mass, it is able to contain and hold a higher temperature then normal, for further combustion. As an example, with a stove top temperature of 575 degrees, the catalyst and the flue gases under the catalyst will be 1475 degrees. The gases coming out of the catalyst will be 975 degrees. The temperature change of 500 degrees is being contained within the Damper.

When the fire is burning very hot, the catalyst is mostly providing a surface burn, but as the fire starts to cool, so does the surface area of the damper. As a natural effect, the smoke and particulate matters then penetrate deep into the embodiment of the element where a much hotter temperature is retained for a longer period of time. This is where the most complete combustion occurs.

The element provides a mass porous area for heat to accumulate, which causes the damper to become extremely hot. When solids and gases exiting the firebox are absorbed into, or trapped on the surface of the damper, they are held there for a long enough period of time for them to be restimulated to burn for a second time. This is a chemical reaction, and the damper is the catalyst causing this reaction.

I claim:

1. A method for producing a stove pipe damper, which comprises:

mixing a plurality of castable refractory materials in a cool, humidified facility, adding a limited amount of ice water sufficient to restrain rapid hardening of the mixture, placing said damp mixture in a two piece mold having a top portion and a bottom portion set with a plurality of upright, tapering pins, compressing said damp mixture in the mold to shape and pierce a plurality of holes in a body formed of said mixture, removing the body from said mold, storing said body on a dampened fabric layered rack in a cool, environment to allow the process of curing and bonding to take place throughout said body, dipping said body in a latex bath to seal the exterior surface, and drying said body in room temperature to obtain a coherent, moisture free body.

2. A method as recited in claim 1, wherein the step of mixing a plurality of refractory material further includes:

pouring approximately 18 pounds of refractory material in a mixer.

3. A method as recited in claim 1, wherein the step of adding ice water to the mixture includes:

supplying enough ice water to dampen the mixture sufficiently so as to adhere together when kneaded, without loss of water.

4. A method as recited in claim 1, wherein the step of compressing said damp mixture in the mold to shape and pierce a plurality of holes in a formed body of said mixture includes, applying a closing force on said mold under a press rated pressure of 12,275 psi and held until tapered pins pierce mold at a press rated pressure of 25,050 psi and push excess mixture out of the top portion of said mold.

5. A method as recited in claim 1, wherein the step of storing said body on a dampened fabric layered rack in a cool environment to allow the process of curing and bonding to take place throughout said body includes:

laying said body on a damp burlap spread, and sprinkling ice water on said body at 15 minute intervals until the particles in said body are thoroughly cured and bonded.

6. A method as recited in claim 1, wherein the step of drying said body in room temperature to obtain a coherent, moisture free damper includes:

drying said body for at least 96 hours.

* * * * *